US010019942B2

(12) United States Patent
Ha

(10) Patent No.: US 10,019,942 B2
(45) Date of Patent: Jul. 10, 2018

(54) DATA DRIVER AND ORGANIC LIGHT EMITTING DIODE DISPLAY DEVICE USING THE SAME

(71) Applicant: LG Display Co., Ltd., Seoul (KR)

(72) Inventor: WonKyu Ha, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 109 days.

(21) Appl. No.: 14/845,222

(22) Filed: Sep. 3, 2015

(65) Prior Publication Data

US 2016/0117991 A1 Apr. 28, 2016

(30) Foreign Application Priority Data

Oct. 22, 2014 (KR) ..... 10-2014-0143629

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2310/027* (2013.01); *G09G 2310/0256* (2013.01); *G09G 2320/0233* (2013.01); *G09G 2320/0276* (2013.01); *G09G 2320/043* (2013.01)

(58) Field of Classification Search
CPC ..... G09G 3/3291; G09G 3/3233; G09G 2310/0256; G09G 2310/027; G09G 2300/0819
See application file for complete search history.

(56) References Cited

U.S. PATENT DOCUMENTS 8,063,855 B2 * 11/2011 Takahara ..... G09G 3/006 345/204
8,681,186 B2 * 3/2014 Park ..... G09G 3/20 345/204
8,797,311 B2 * 8/2014 Kim ..... G09G 3/3233 345/173
8,836,691 B2 * 9/2014 Ryu ..... G09G 3/3233 345/214
2008/0018655 A1 * 1/2008 Han ..... G09G 3/3233 345/545

(Continued)

FOREIGN PATENT DOCUMENTS

CN 1881399 A 12/2006
CN 1975847 A 6/2007

(Continued)

OTHER PUBLICATIONS

Chinese Office Action Chinese Application No. 201510691044.8, Aug. 28, 2017, 17 pages.

*Primary Examiner* — Abbas Abdulselam
(74) *Attorney, Agent, or Firm* — Fenwick & West LLP

(57) ABSTRACT

A data driver and a display device using the same are disclosed. The data driver includes a digital to analog conversion unit for converting a digital signal into either a positive polarity analog signal or a negative polarity analog signal, and an output circuit unit for outputting either the positive polarity analog signal or the negative polarity analog signal, as an output signal, to a transistor that supplies a current to an organic light emitting diode (OLED).

13 Claims, 12 Drawing Sheets

(56) References Cited

U.S. PATENT DOCUMENTS

| | | | | |
|---|---|---|---|---|
| 2009/0295691 | A1* | 12/2009 | Handa | G09G 3/3233<br>345/76 |
| 2009/0303219 | A1* | 12/2009 | Kimura | G09G 3/3688<br>345/211 |
| 2010/0134451 | A1* | 6/2010 | Cho | G09G 3/3677<br>345/205 |
| 2014/0118410 | A1* | 5/2014 | Oh | G09G 3/3208<br>345/690 |

FOREIGN PATENT DOCUMENTS

| | | | |
|---|---|---|---|
| CN | 101751885 | A | 6/2010 |
| CN | 102469340 | A | 5/2012 |

* cited by examiner

VCCp
Image Data
GMA17
GMA16
GMA15
GMA3
GMA2
GMA1
153a
154a
155
$V_0$+
$V_0$−
−GMA1
−GMA2
−GMA3
−GMA4
154b
153b
Black Data
VCCn

DATA DRIVER AND ORGANIC LIGHT EMITTING DIODE DISPLAY DEVICE USING THE SAME

CROSS-REFERENCE TO RELATED APPLICATION

This application claims priority from and the benefit under 35 U.S.C. § 119(a) of Korean Patent Application No. 10-2014-0143629, filed on Oct. 22, 2014, which is hereby incorporated by reference for all purposes as if fully set forth herein.

BACKGROUND

1. Related Field

The present invention relates to a display device that displays images.

2. Description of the Prior Art

Display devices, such as, a liquid crystal display (LCD), an organic light emitting diode display (OLED), an electrophoretic display (EPD), and a plasma display panel (PDP) have been increasingly used.

In particular, the organic light emitting diode display device includes a driving transistor for supplying a current to the organic light emitting diode (OLED). The threshold voltage (Vth) of the driving transistor can be positive-shifted and deteriorated. However, the compensation circuit may not be able to compensate the positive shift in the threshold voltage and the deterioration of the driving transistor.

SUMMARY

A data driver for delaying the deterioration of the transistor for supplying a current to the organic light emitting diode (OLED) and an organic light emitting diode display device using the same are disclosed.

The data driver includes: a digital to analog conversion unit for converting a digital signal into either a positive polarity analog signal or a negative polarity analog signal, and an output circuit unit for outputting either the positive polarity analog signal or the negative polarity analog signal, as an output signal, to a transistor that supplies a current to an organic light emitting diode (OLED).

In accordance with another aspect, an organic light emitting diode display device includes: a display panel including two or more pixels, each of which includes an organic light emitting diode (OLED) and a transistor that supplies a current to the organic light emitting diode (OLED); a data driver for converting a digital signal into either a positive polarity analog signal or a negative polarity analog signal and for outputting the converted signal to the transistor of each of the pixels; and a timing controller for controlling the data driver.

In various embodiments, deterioration of the transistor for supplying a current to the organic light emitting diode (OLED) can be delayed.

BRIEF DESCRIPTION OF THE DRAWINGS

The above and other objects, features and advantages of various embodiments will be more apparent from the following detailed description taken in conjunction with the accompanying drawings, in which.

DETAILED DESCRIPTION

Figure 1:
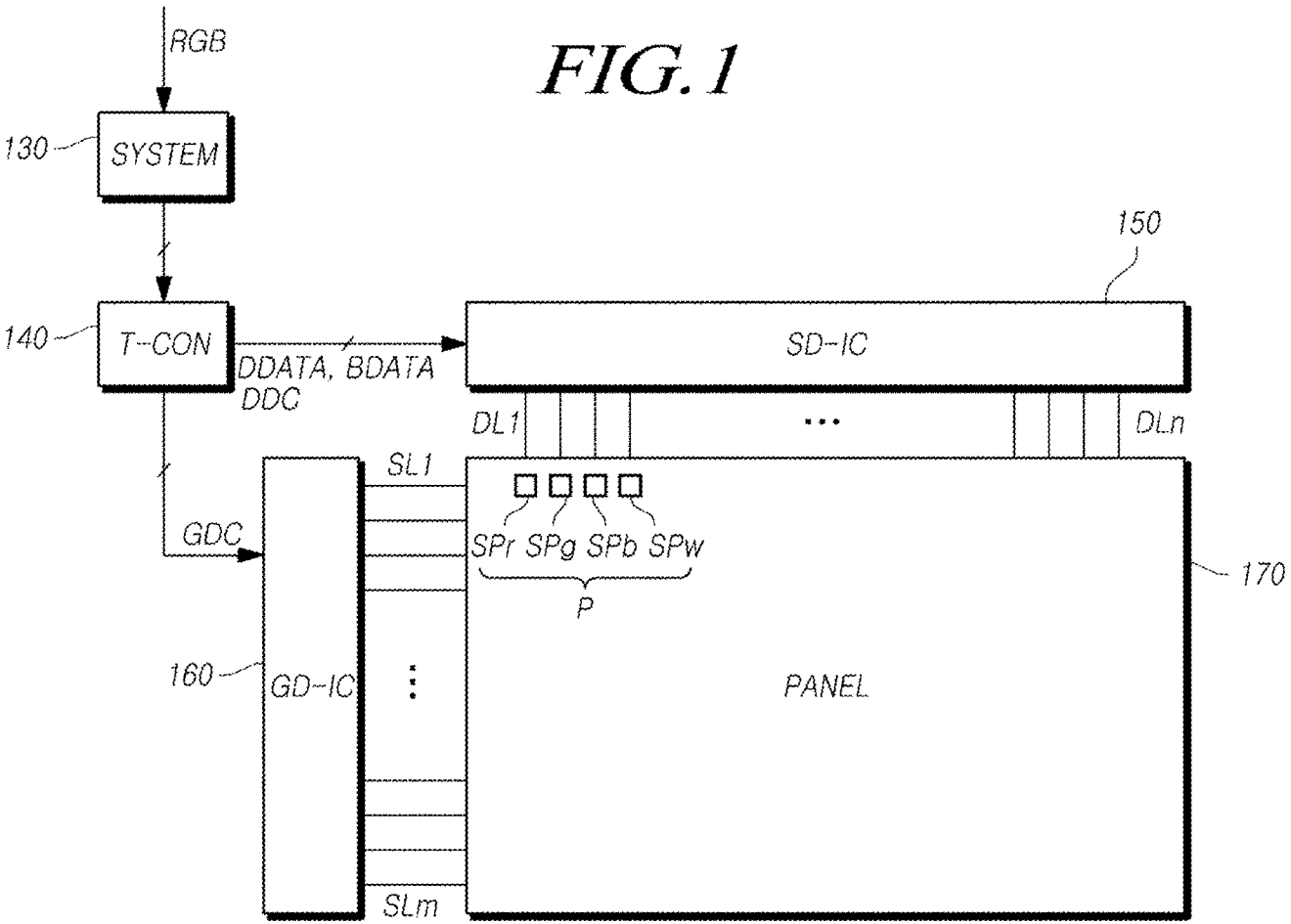
FIG. 1 is a schematic configuration view of an organic light emitting diode display device according to an embodiment.

Hereinafter, various embodiments will be described with reference to the accompanying drawings. In designating elements of the drawings by reference numerals, the same elements will be designated by the same reference numerals although they are shown in different drawings. Further, in the following description of the present disclosure, detailed descriptions of known functions and configurations incorporated herein will be omitted when the subject matter of the present disclosure may be rendered unclear.

In addition, terms, such as first, second, A, B, (a), (b) or the like may be used herein when describing components of various embodiments. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

Figure 2:
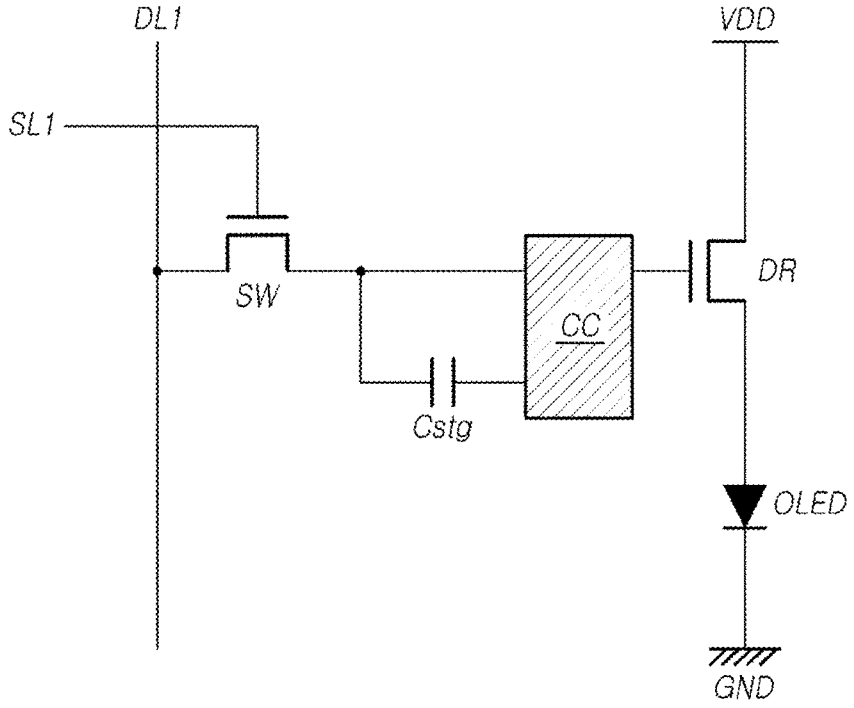
FIG. 2 is an exemplary view of a schematic circuit configuration of a sub-pixel.

FIG. 1 is a schematic configuration view of an organic light emitting diode display device according to an embodiment, and FIG. 2 is an exemplary view of a schematic circuit configuration of a sub-pixel.

As shown in FIG. 1, a display device according to an embodiment includes a timing controller 140 (T-CON), a data driver 150 (SD-IC), a scan driver 160 (GD-IC), and a display panel 170 (PANEL).

The system board unit 130 is supplied with a video data signal from the outside and converts the video data signal into a digital data signal, and outputs driving signals, such as, a data enable signal, a vertical synchronization signal, a horizontal synchronization signal and a clock signal. The system board unit 130 converts the video data signal into the digital data signal. The timing controller 140 may also convert the video data signal into the digital data signal.

The timing controller 140 is supplied with a color data signal DDATA as well as the driving signals, such as, the data enable signal, the vertical synchronization signal, the horizontal synchronization signal, and the clock signal from the system board unit 130. The timing controller 140 outputs a gate timing control signal GDC for controlling the operation timing of the scan driver 160, based on the driving signal, and a data timing control signal DDC for controlling the operation timing of the data driver 150. The timing controller 140 outputs the color data signal DDATA corresponding to a gate timing control signal GDC and a data timing control signal DDC generated on the basis of the driving signal.

The data driver 150 samples and latches the color data signal DDATA, in response to the data timing control signal DDC supplied from the timing controller 140, and then converts the sampled and latched color data signal into an analog data signal corresponding to the gamma reference voltage. The data driver 150 may be formed of an Integrated Circuit (IC) type, but it is not limited thereto.

The scan driver 160 outputs a scan signal while shifting the level of the gate voltage in response to a gate timing control signal GDC supplied from the timing controller 140. The scan driver 160 outputs scan signals via scan lines SL1 through SLm. The scan driver 160 may be formed of an Integrated Circuit (IC) type, or can be implemented in the display panel 170 using a gate in panel method but is not limited thereto.

The display panel 170 is implemented as a sub-pixel structure including a red sub-pixel SPr, a green sub-pixel SPg, and a blue sub-pixel SPb (hereinafter, abbreviated as RGB sub-pixels). Alternatively, the display panel 170 is implemented as a sub-pixel structure including a red sub-pixel SPr, a green sub-pixel SPg, a blue sub-pixel SPb and a white sub-pixel SPw (hereinafter, abbreviated as RGBW sub-pixels), in order to prevent a decrease in luminance and color sense of a pure color while increasing a light efficiency. That is, one pixel (P) is configured by RGB sub-pixels (SPr, SPg, SPb) or RGBW sub-pixel (SPr, SPg, SPb, SPw). Further, a plurality of such pixels (P) are implemented according to the resolution of the display panel 170.

As shown in FIG. 2, one sub-pixel includes a switching transistor SW, a driving transistor DR, a capacitor Cstg, a compensation circuit (CC) and an organic light emitting diode (OLED). The organic light emitting diode (OLED) operates to emit light according to the driving current that is formed by the driving transistor DR. A switching transistor SW performs a switching operation in response to a scan signal supplied through a first scan line SL1 such that the color data signal supplied through the first data line DL1 is stored as a data voltage in a capacitor Cst. The driving transistor DR operates such that the driving current flows between a first power supply line VDD and a ground line GND depending on the data voltage stored in the capacitor Cst.

The compensation circuit (CC) is a circuit added to compensate the threshold voltage of the driving transistor DR. Accordingly, the compensation circuit (CC) may be omitted depending on the configuration of the sub-pixels, but typically is composed of one or more transistors and a capacitor. Various configurations of the compensation circuit (CC) can be implemented.

One sub-pixel is configured by a 2T (Transistor) 1C (Capacitor) structure including a switching transistor SW, a driving transistor DR, a capacitor Cst and an organic light emitting diode (OLED). However, when the compensation circuit (CC) is added, the sub-pixel is configured by 3T1C, 4T2C, 5T2C, or the like. The sub-pixel having the structure as described above, depending on the structure, is formed by a top-emission method, a bottom-emission method or a dual emission method.

Figure 12:
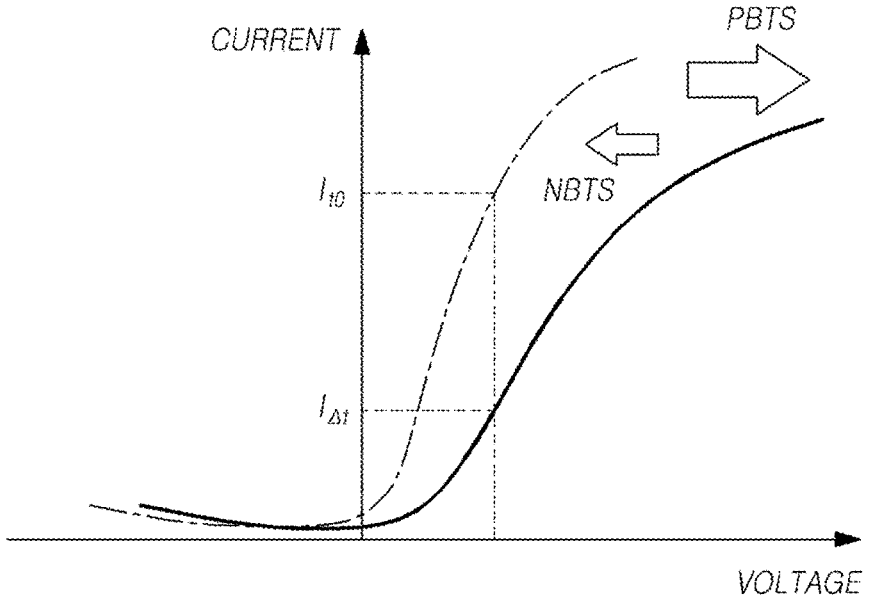
FIG. 12 shows the change in the characteristics of a driving transistor due to deterioration and degradation delay of an embodiment.

Even if the compensation circuit (CC) compensates a threshold voltage of a driving transistor DR, the driving transistor DR is applied with positive bias temperature stress (PBTS) and current stress (CS) as shown in FIG. 12, due to the characteristics of the transistors, the threshold voltage (Vth) of the driving transistor can be positive-shifted. As a result, the deterioration of the driving transistor occurs. Meanwhile, when the pixel does not represent an image, that is, for the pixels representing black, the gate and source voltages of the driving transistor will have the same potential.

Hereinafter, when black data in which pixels do not represent images is input, embodiments disclosed herein may delay the deterioration of each of the driving transistors DR in real-time in proportion to the degree of deterioration of the driving transistor DR of each pixel depending on the positive bias temperature stress (PBTS) and current stress (CS).

Figure 3:
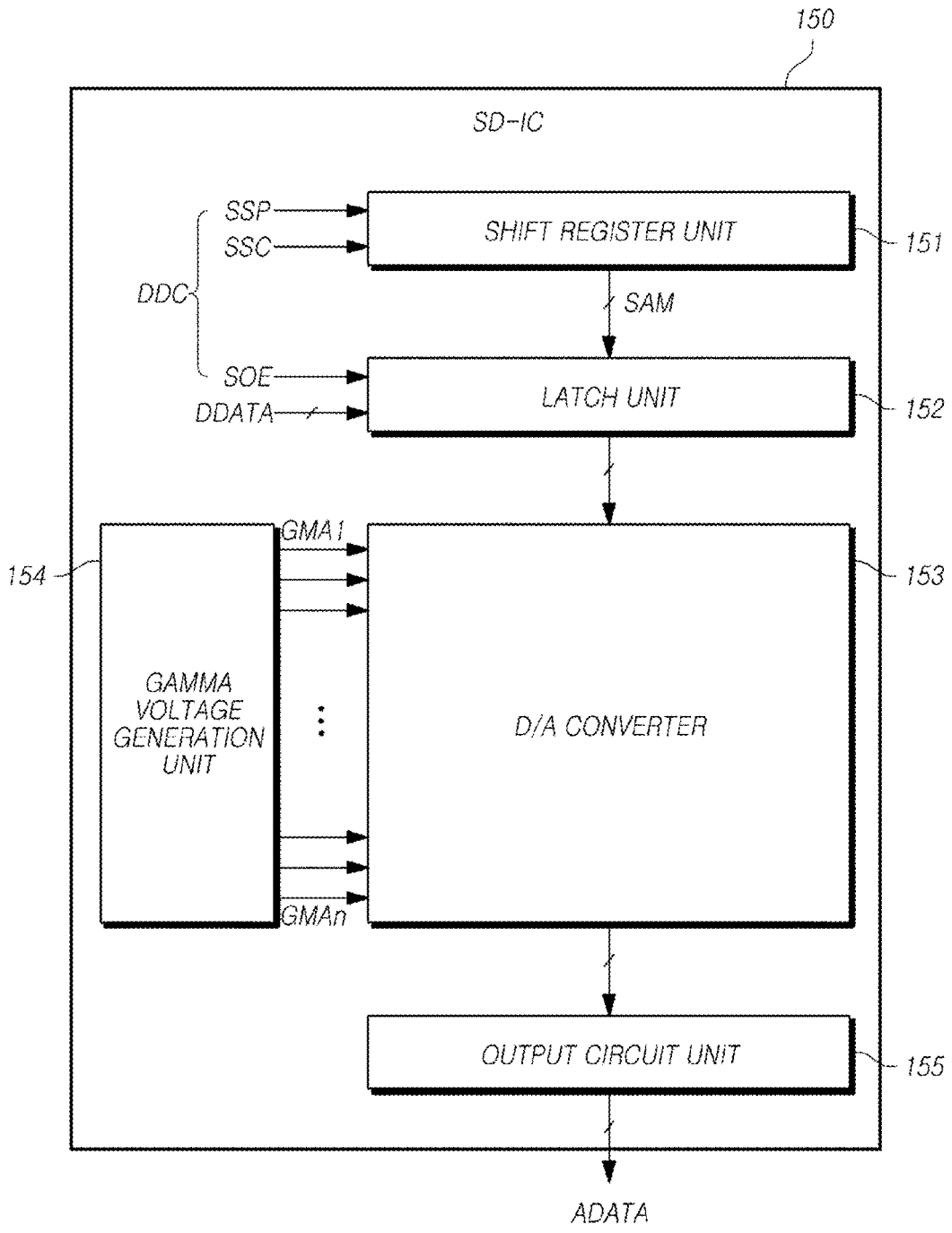
FIG. 3 is a schematic configuration view of a data driver of FIG. 1.
Figure 4:
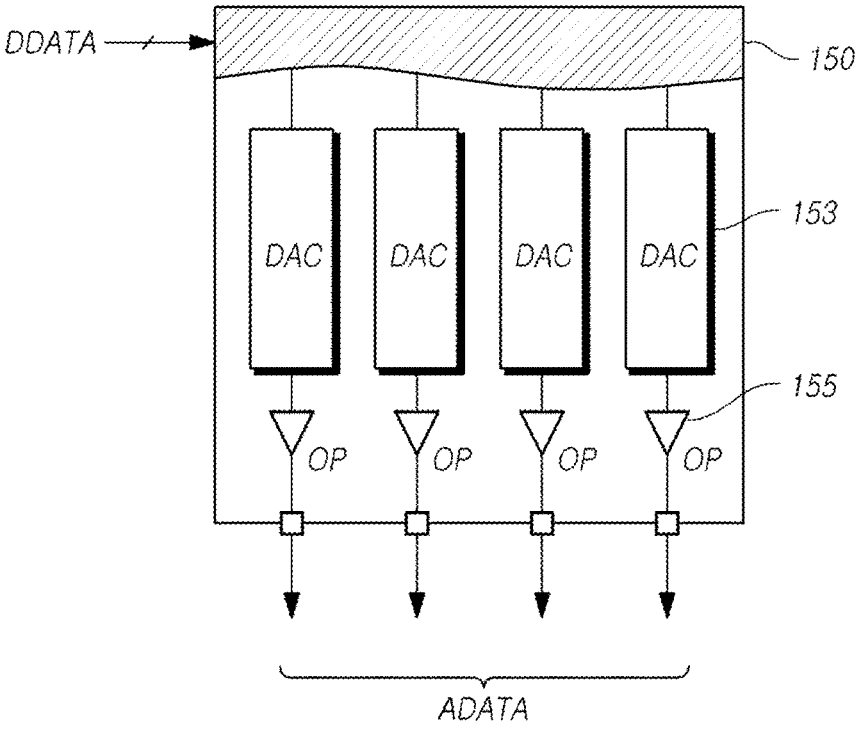
FIG. 4 shows configurations of some of a data driver.
Figure 5:
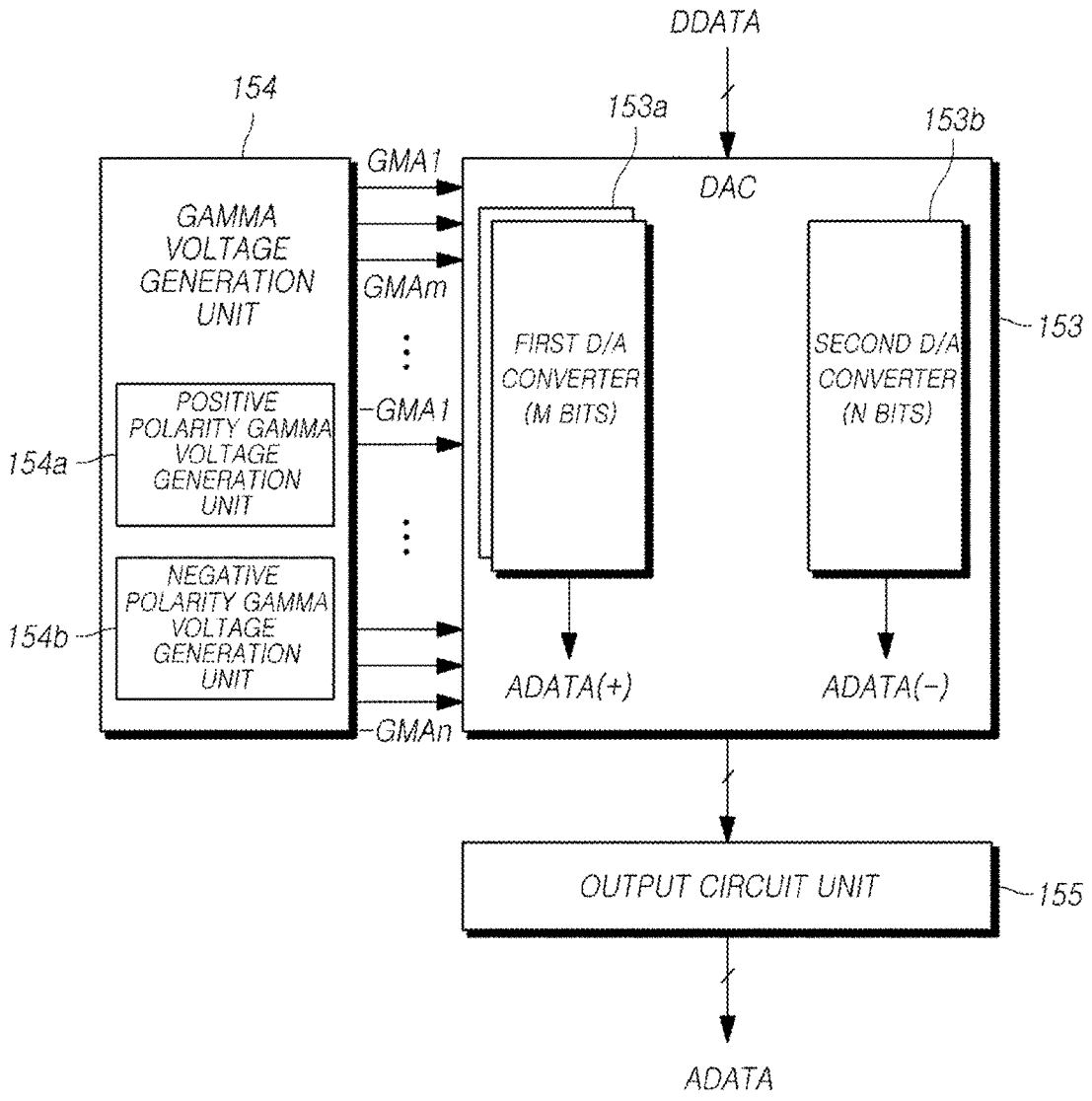
FIG. 5 is a configuration view of some of a gamma voltage generation unit and a data driver, and a configuration of an output circuit unit.

FIG. 3 is a schematic configuration view of a data driver of FIG. 1. FIG. 4 shows configurations of a portion of a data driver. FIG. 5 illustrates configurations of a portion of a gamma voltage generation unit, a data driver, and output circuit unit.

The timing controller 140 and the data driver 150 are bonded by data communication interface (IF1, IF2). The timing controller 140 transmits the color data signal DDATA along with the data timing control signal DDC via a first interface (IF1) of the timing controller itself. The data driver 150 receives the color data signal DDATA along with the data timing control signal DDC transmitted from the timing controller 140 via a second interface (IF2) of the data driver itself.

A shown in FIG. 3, the data driver 150 includes a shift register unit 151, a latch unit 152, a gamma voltage generation unit 154, a digital to analog conversion unit (hereinafter, abbreviated as a DA conversion unit) 153 and an output circuit unit 155.

The data timing control signal DDC output from the timing controller 140 includes a source start pulse SSP, a source sampling clock SSC, a source output enable signal SOE or the like. The source start pulse SSP controls the data sampling start time point of the data driver 150. The source sampling clock SSC, based on the rising or falling edges, is a clock signal for controlling the data sampling operation within the data driver 150. The source output enable (SOE) signal controls the output of the data driver 150.

The shift register unit 151 outputs the sampling signal SAM in response to a source start pulse SSP and a source sampling clock SSC output from the timing controller 140.

The latch unit 152 sequentially samples a digital color data signal DDATA, in response to a sampling signal SAM outputted from the shift register unit 151, and simultaneously outputs the color data signal for one line which is sampled corresponding to the source output enable signal (SOE). The latch unit 152 may be configured by at least two latch units, however only one latch unit is illustrated and described for convenience of explanation.

Referring to FIGS. 4 and 5, the gamma voltage generation unit 154 generates a reference gamma voltage corresponding to the voltage or signal supplied from outside or inside. That is, according to the characteristics of the display device 100, the gamma voltage generation unit 154 may include a positive polarity gamma voltage generator 154*a* which generates a positive polarity reference gamma voltage of the first to the $m^{th}$ reference gamma voltages GMA1 through GMAm which corresponds to each gradation subdivided into the number of gradations that can be expressed by the number of bits of the digital signal and a negative polarity gamma voltage generator 154*b* which generates a negative polarity reference gamma voltage of the first to the $n^{th}$ reference gamma voltages GMA1 through GMAn.

FIG. 5 shows that the gamma voltage generation unit 154 is included in the data driver 150 in one embodiment. However, the gamma voltage generation unit 154 may not be included in the data driver 150 in another embodiment. For example, a gamma voltage generation unit 154 may be located in the power supply (not shown) outside the data driver 150.

As shown in FIG. 5, the DA conversion unit 153 converts a digital color data signal DDATA for one line into an analog color data signal ADATA corresponding to the reference gamma voltage outputted from the gamma voltage generation unit 154. That is, the DA conversion unit 153 outputs the digital signal as the analog signal based on the reference gamma voltage supplied from the gamma voltage generation unit 154.

The DA conversion unit 153 includes first digital-to-analog converter (first DAC) 153*a* which receives the positive reference gamma voltage of the first to the $m^{th}$ reference gamma voltages GMA1 through GMAm and converts the digital signal to the positive polarity analog signal ADAVA (+), and a second digital-to-analog converter (second DAC) 153*b* which receives the negative polarity reference gamma voltage of the first to the $n^{th}$ reference gamma voltages GMA1 through GMAn and outputs the digital signal into the negative polarity analog signal ADAVA(−).

The first DAC 153*a* may be an M-bit DAC which receives the positive polarity reference gamma voltage of the first to the $m^{th}$ reference gamma voltages GMA1 through GMAm and converts the M-bit digital signal (M is a natural number greater than 1) into the positive polarity analog signal. The positive polarity reference gamma voltage includes reference gamma voltages which have the first to the $m^{th}$ reference gamma voltages GMA1 through GMAm, $m=2^M$ corresponding to each gradation divided into the number of gradations ($2^M$) that can be expressed by the number of bits of M-bit digital signal. For example, when the first DAC 153*a* is a DAC of 10 bits, the first DAC 153*a* receives $2^{10}$ positive polarity reference gamma voltages and converts the 10-bit digital signal into positive polarity analog signals.

The second DAC 153*b* may be an N-bit DAC which receives the negative polarity reference gamma voltage of the first to the $n^{th}$ reference gamma voltages GMA1 through GMAn and converts the N-bit digital signals (where, N is a natural number greater than 1) into negative polarity analog signals. A negative polarity reference gamma voltage includes reference gamma voltages which have the first to the $n^{th}$ reference gamma voltage GMA1 through GMAn, $n=2^N$ corresponding to each gradation divided into the number of gradations ($2^N$) that can be expressed by the number of bits of an N-bit digital signal. For example, when the second DAC 153*b* is a four-bit DAC, the second DAC 153*b* receives $2^4$ negative reference gamma voltages and converts the 4-bit digital signal into the negative polarity analog signals.

The M and N, described above, can be the same, or M may be greater or smaller than N. In particular, M may greater than N. The expression that M is greater than N means that the resolution, for converting a digital signal into an analog signal, of the first DAC 153*a* is greater than the resolution of the second DAC 153*b*. In addition, the expression that M is greater than N means that the number $m=2^M$ of positive polarity gamma reference voltages is greater than the number $n=2^N$ of negative polarity gamma reference voltages. Herein, an example in which M is greater than N has been described in an illustrative manner. Alternatively, M may be equal to or less than N.

The output circuit unit 155 amplifies (or amplifies and compensates) analog color data signals ADATA output from the DA conversion unit 153 and then outputs the amplified signals to each of the data lines. The output circuit unit 155 outputs one of the positive analog signal ADAVA(+) and the negative polarity analog signal ADAVA(−), as an output signal, to a transistor that supplies a current to the organic light emitting diode (OLED).

Figure 6:
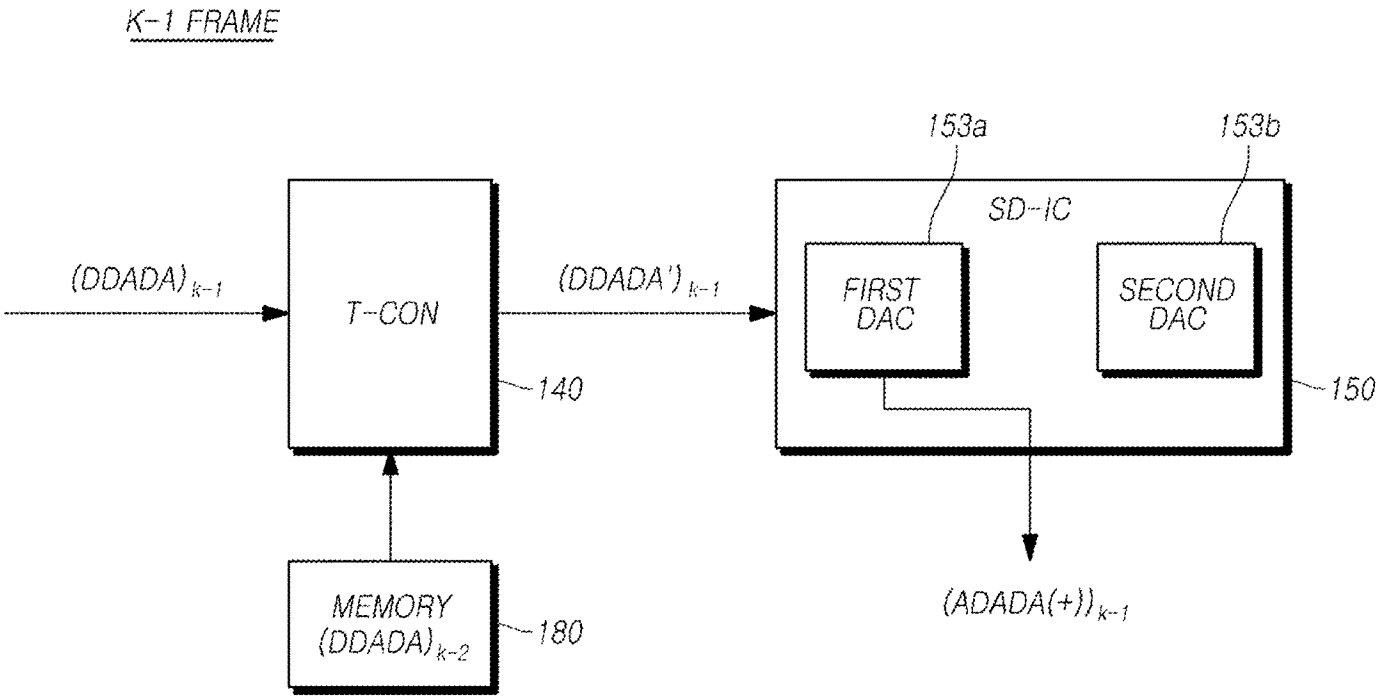
FIGS. 6 and 7 show a timing controller, a data driver, and a memory included in a display device.
Figure 7:
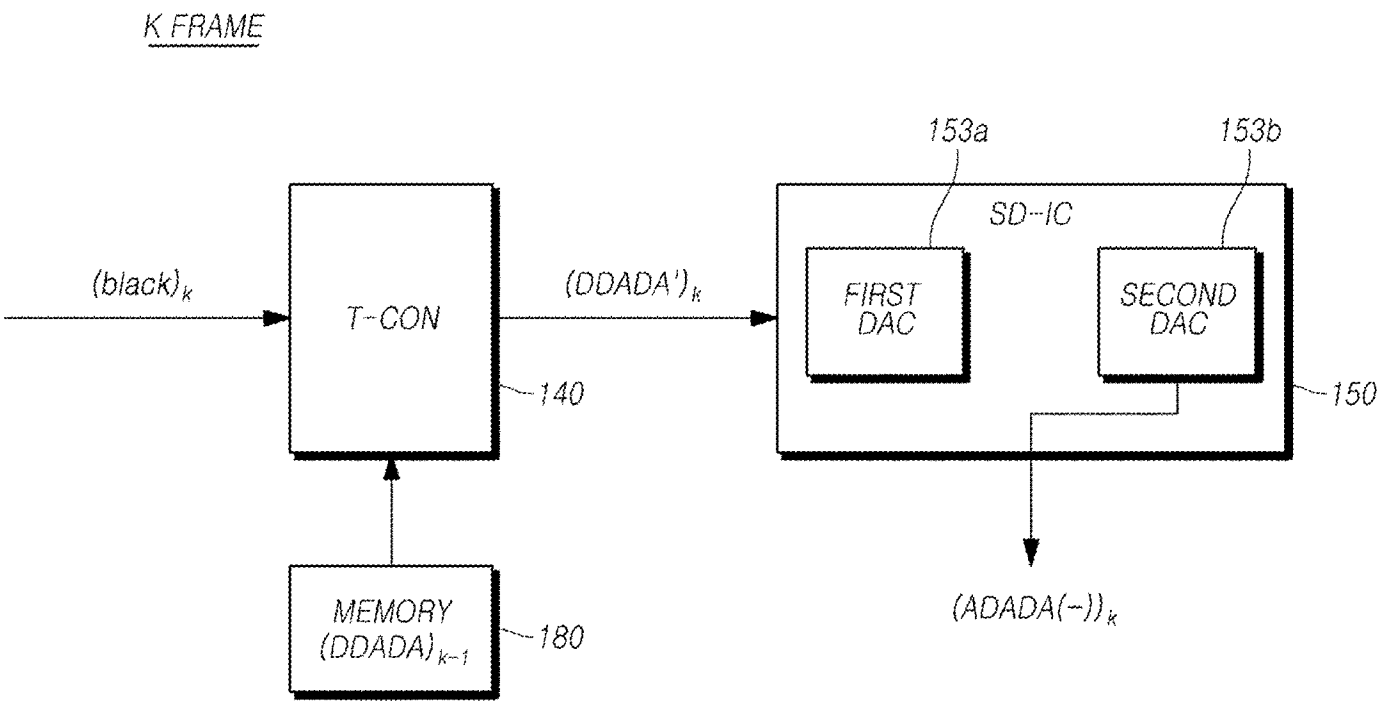

FIGS. 6 and 7 illustrate a timing controller, a data driver, and a memory included in a display device.

Referring to FIGS. 6 and 7, the display device 100 includes the timing controller 140 and the data driver 150 shown in FIG. 1 and further includes a memory 180 that stores data.

Referring to FIG. 6, the timing controller 140, in K−1 frame, converts a digital signal $(DDADA)_{K-1}$ of a particular pixel supplied from the system board unit 130 into a digital signal $(DDADA')_{K-1}$ to drive the display panel 170 according to various compensation/conversion algorithms.

As shown in FIG. 6, when the digital signal (DDADA) of a particular pixel supplied from the system board unit 130 in K−1 frame is not black data representing a black image, the timing controller 140 converts a digital signal $(DDADA)_{K-1}$ of a particular pixel into a digital signal $(DDADA')_{K-1}$ to drive the display panel 170 according to a general compensation/conversion algorithm.

The first DAC 153*a* of the data driver 150 converts the digital signal $(DDADA')_{K-1}$ supplied from the timing controller 140 into the positive polarity analog signals ADADA (+) based on the positive polarity reference gamma voltage.

Meanwhile, as shown in FIG. 7, when the digital signal (DDADA) of a particular pixel is supplied from the system board unit 130 in a K frame, which corresponds to black data representing a black image, the timing controller 140 converts a digital signal DDADA of a particular pixel, that is, black data K into a digital signal $(DDADA')_K$, in proportion to the magnitude of a digital signal $(DDADA')_{K-1}$ of the pixel in a K−1 frame. The timing controller 140 stores the digital signal DDADA of the pixel in the K−1 frame or the digital signal $(DDADA')_{K-1}$ in the K−1 frame in the memory 180.

The second DAC 153*b* of the data driver 150 converts black data K supplied from the timing controller 140, based on the negative polarity reference gamma voltage, into the negative polarity analog signal $ADADA(-)_K$. In one aspect, the second DAC 153*b* of the data driver 150 converts the black data K into the negative polarity analog signal $ADADA(-)_K$ in proportion to the magnitude of the positive polarity analog signal ADADA(+) in K−1 frame.

Figure 8:
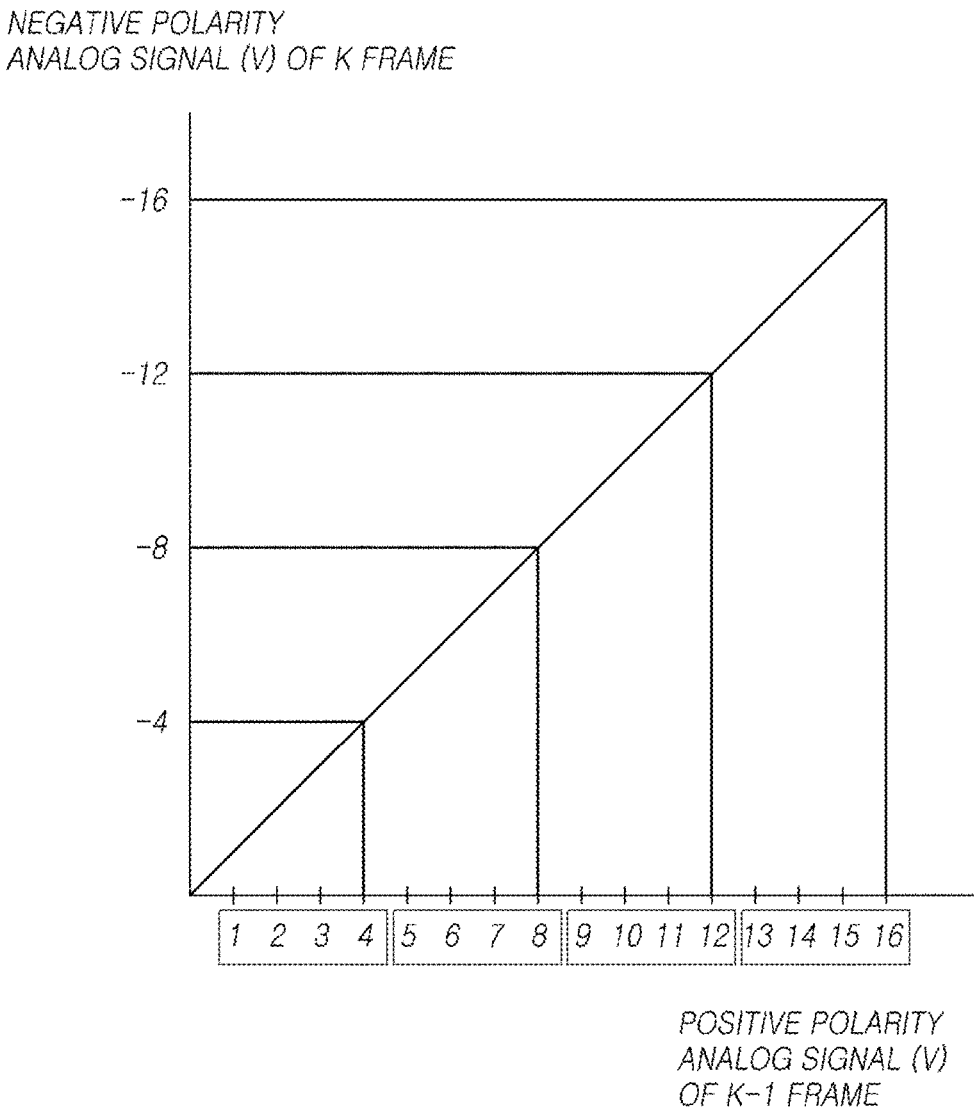
FIG. 8 shows a relationship between the magnitude of a positive polarity analog signal of K−1 frame and a magnitude of a negative polarity analog signal of and K frame.
Figure 9:
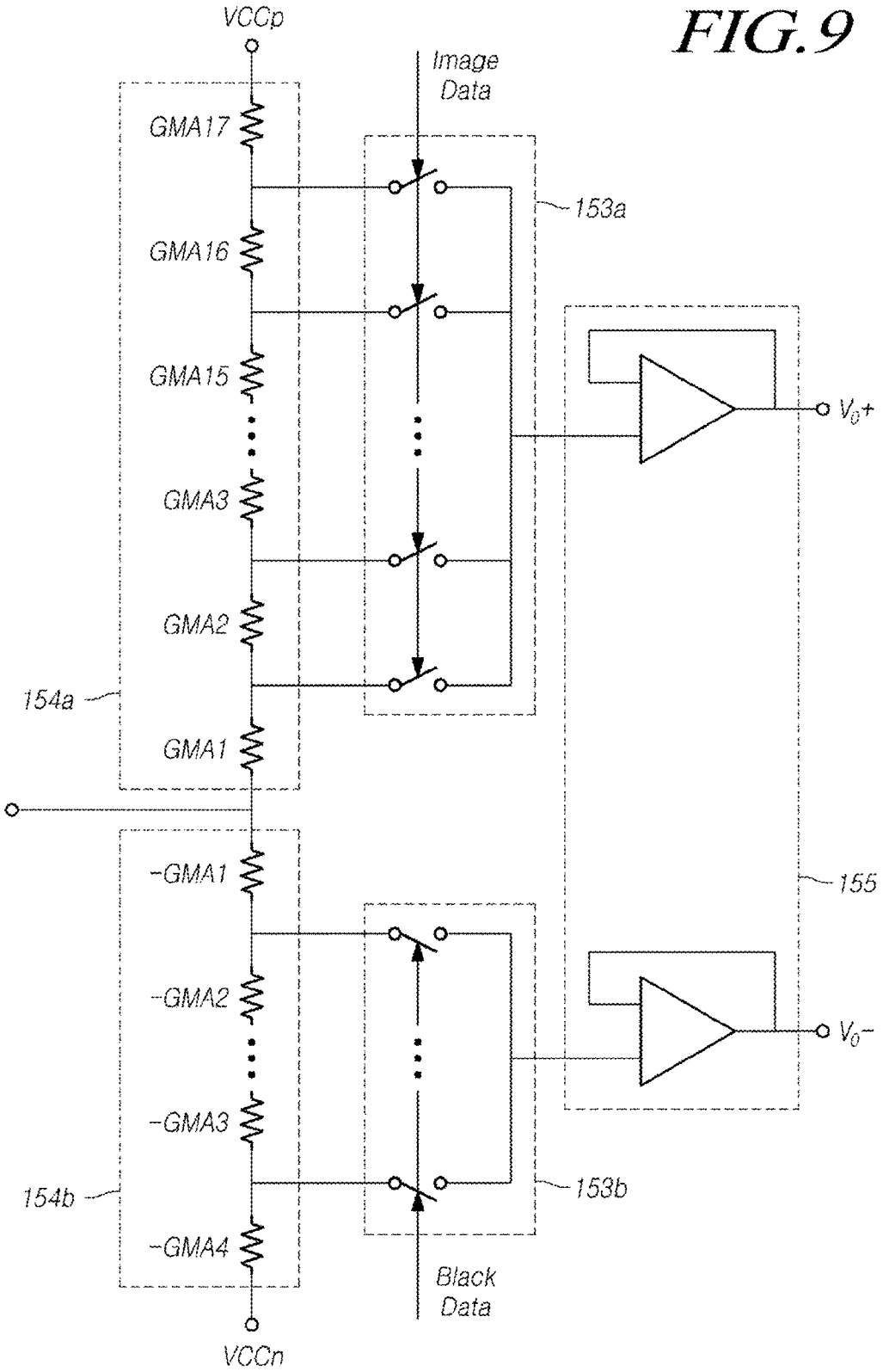
FIG. 9 is a circuit diagram of some of a data driver including a four-bit first DAC and a two-bit second DAC.

FIG. 8 shows the relationship between the magnitude of a positive polarity analog signal of the K−1 frame and a negative polarity analog signal of K frame. FIG. 9 is a partial circuit diagram of a data driver including a 4-bit first DAC and a 2-bit second DAC.

Referring to FIG. 8, as described above, the magnitude of the negative polarity analog signal $ADADA(-)_K$ corresponding to the black data $(black)_K$ of the K frame is proportional to the magnitude of the positive polarity analog signal $ADADA(+)_{k-1}$ corresponding to the digital signal $(DDADA)_{K-1}$ of the K−1 frame. In this example, the resolution of the positive polarity analog signal $ADADA(+)_{K-1}$ is higher than the resolution of the negative polarity analog signal $ADADA(-)_k$. The absolute value of the maximum value of the magnitude of the positive polarity analog signal is the same as the absolute value of the minimum value of the magnitude of the negative polarity analog signal but it is not limited thereto.

For example, when the resolution of the positive polarity analog signals $ADADA(+)_{K-1}$ corresponds to 10 bits, that is, 1024, the resolution of the negative polarity analog signal can be 4 bits, that is, 16. As described above, the first DAC 153*a* converts the 10-bit digital signal into one of the 1024 analog signals. On the other hand, the second DAC 153*b* may convert the 4-bit digital signal into one of the 16 analog signals.

In more detail, as shown in FIG. 9, an example of the DA conversion unit 153 which includes the four-bit first DAC 153*a* and the two-bit second DAC 153*b* will be described. In this example, the positive polarity gamma voltage generator 154*a* generates $2^4$=16 positive reference gamma voltages GMA1 through GMA16, and the negative polarity gamma voltage generator 154*b* generates $2^2$=4 negative polarity reference gamma voltages −GMA1 through −GMA4. In this example, the absolute value of the magnitude of the maximum value GMA16 of the positive polarity analog signal is the same as the absolute value of the minimum value −GMA4 of the negative polarity analog signal.

When the 4-bit digital signal (image data) is input, the 4-bit first DAC 153*a* converts the input 4-bit digital signal into one positive polarity analog signal $V_o^+$ with reference to 16 positive polarity reference gamma voltages GMA1 through GMA16.

When the 4-bit digital signal is black data representing black, the 2-bit second DAC 153*b* converts the digital signal representing the black in the frame into the negative polarity analog signal $V_o^-$ in proportion to the magnitude of the digital signal of the previous frame as described with reference to FIG. 7.

As shown in FIG. 8, for example, when the analog signal corresponding to the digital signal of the previous frame is between 1 V and 4 V, a digital signal representing the black in the frame may be converted to −4 V negative polarity analog signals $V_o^-$. Similarly, when the analog signal corresponding to the digital signal of the previous frame is between 5 V and 8 V, the digital signals representing the black in the frame may be converted to −8V negative polarity analog signal $V_o^-$. When the analog signal corresponding to the digital signal of the previous frame is between 9 V and 12 V, the digital signal representing the black in the frame can be converted to −12 V negative polarity analog signals $V_o^-$. When the analog signal corresponding to the digital signal of the previous frame is between 13 V and 16 V, the digital signal representing the black in the frame can be converted to −16V negative polarity analog signal $V_o^-$.

Converting the digital signals representing the black in the frame to negative polarity analog signals $V_o^-$ in linear proportion to the analog signal corresponding to the digital signal of the previous frame has been described with reference to FIG. 8, but is not limited thereto. For example, the digital signal representing the black in the frame may be converted into the negative polarity analog signal $V_o^-$ in non-linear (for example, the exponential or parabolic curve) proportion to the analog signal corresponding to the digital signal of the previous frame.

Thus, in the organic light emitting diode display device, it is possible to delay the deterioration of the driving transistor DR for each pixel in real time, in proportion to the degree of deterioration of the driving transistor DR for each pixel.

Figure 10:
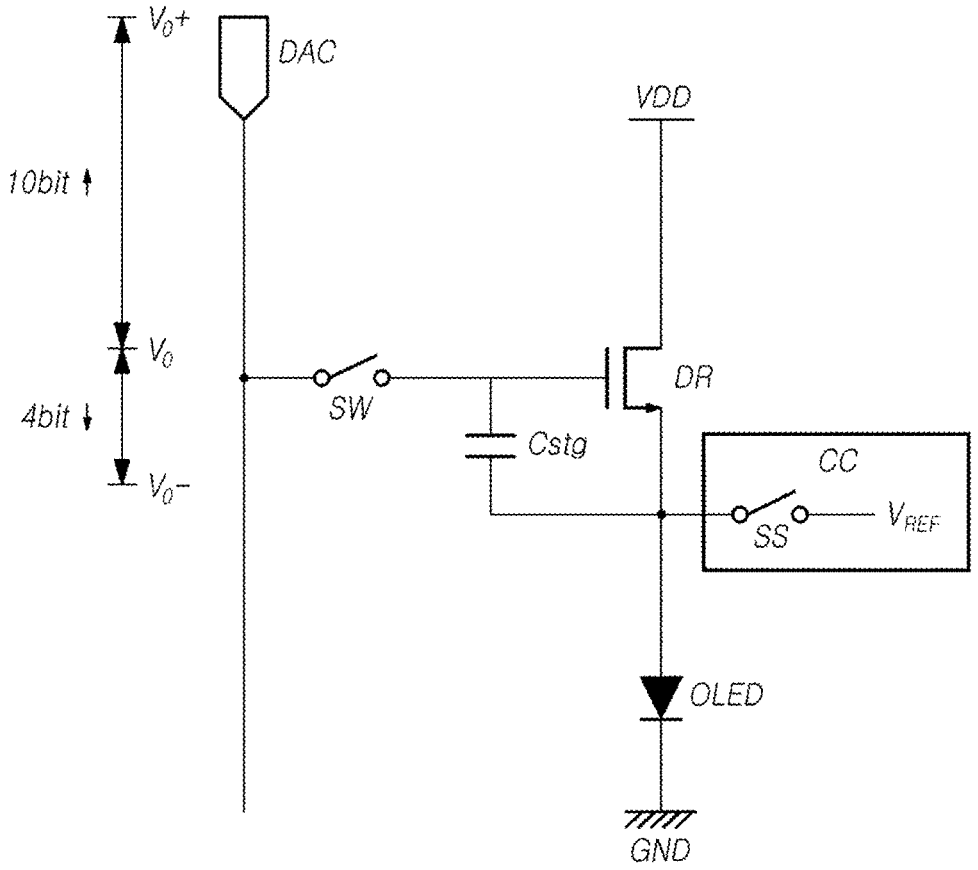
FIGS. 10 and 11 are exemplary views of a detailed circuit configuration of sub-pixels in FIG. 2.
Figure 11:
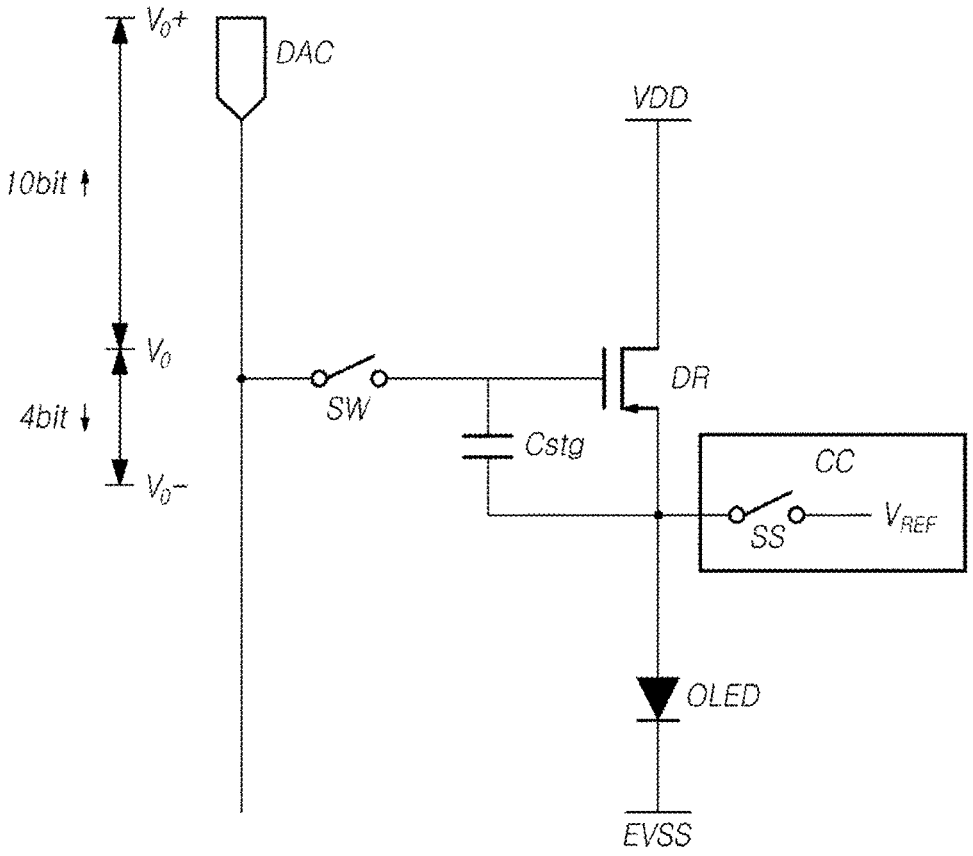

FIGS. 10 and 11 are exemplary views of a detail circuit configuration of sub-pixels in FIG. 2.

Referring to FIGS. 10 and 11, one sub-pixel includes a switching transistor SW, a driving transistor DR, a capacitor (Cst), a compensation circuit (CC) and an organic light emitting diode (OLED). In one example, the compensation circuit (CC) includes a sensing transistor (SS) for applying a reference voltage (VREF) applied to sense a characteristic value (threshold voltage, mobility, etc.) of the driving transistor.

As shown in FIG. 10, when the pixel displays a black image, an N-type driving transistor (e.g., N-type thin film transistor (TFT)) has a gate voltage lower than a source voltage. During the driving of an organic light emitting diode display device, a negative polarity analog signal can be applied which is lower than a source node of the driving transistor DR of a pixel representing the black. Therefore, the second DAC 153*b* converts the digital signal representing the black into a negative polarity analog signal having a voltage lower than the source voltage of the driving transistor.

On the other hand, as shown in FIG. 11, when the pixel represents a black image, a P-type driving transistor (e.g., P-type TFT) has a gate voltage lower than the drain voltage. During the driving of an organic light emitting diode display device, it is possible to apply a negative polarity analog signal having a voltage lower than a drain node of the driving transistor DR of a pixel representing the black. Therefore, the second DAC 153*b* converts the digital signal representing the black into a negative polarity analog signal having a voltage lower than the drain voltage of the driving transistor.

Therefore, the second DAC 153*b* may convert the digital signal representing the black into a negative polarity analog signal having a voltage lower than the source voltage and the drain voltage of the driving transistor.

FIG. 12 shows the change in the characteristics of a driving transistor due to deterioration and degradation delay of an example.

In one embodiment, for the pixels representing the black, a gate voltage lower than the source voltage of the P-type driving transistor as shown in FIG. 10 or the drain voltage of the N-type driving transistor as shown in FIG. 11 is applied so that negative bias temperature stress (NBTS) is applied for each pixel during driving as shown in FIG. 12, the threshold voltage (Vth) of the driving transistor can be negative-shifted, and thus deterioration of the driving transistor can be delayed.

In this case, as described above, for the gate voltage, a negative polarity analog voltage is written in a current frame (frame k) of a pixel representing black in proportion to the positive polarity analog voltage in the previous frame (frame k−1).

In order to apply a negative polarity analog voltage, a negative polarity analog voltage on the current frame (frame k) can be applied in proportion to the gradation expressed in the previous frame (frame k−1) of the driving transistor.

In order to write the black negative polarity analog voltage of the current frame in proportion to the positive polarity analog voltage of the previous frame, the DA conversion unit 153 in the data driver 150 for data writing may output all the positive polarity and negative polarity analog voltages. For example, when the data driver 150 for driving the display device 100 outputs only the positive polarity analog voltage, the maximum output voltage is 16V and the resolution will be 10 bits (or eight bits).

For the positive polarity and negative polarity analog voltage outputs in the above-described embodiments, the positive polarity analog voltage is designed with the same characteristics as one which outputs only the positive polarity analog voltage, however for the negative polarity analog voltage, for example, it is designed that the minimum output voltage is −16V and the resolution is four bits or less so that it can implemented without greatly increasing the area (price) of the data driver 150.

According to the embodiment described above, the Negative Bias Temperature Stress (NETS) is applied to the pixel which represents black in the process of representing an image and thus the effect of delaying the degradation of the driving transistor without loss of light emission time can be achieved.

In addition, according to the embodiment described above, the adaptive negative polarity voltage is written per pixel in proportion to the PBTS and thus there is a delay effect on the local residual image.

Although various embodiments disclosed herein have been described above with reference to the accompanying drawings, it will be understood that those skilled in the art may implement the above described technical features of various embodiments disclosed herein in other specific manners without changing the technical idea or essential features. Therefore, it should be understood that the above described embodiments are not limitative but are illustrative in all aspects. Further, the scope of embodiments is defined by the following appended claims, rather than the above detailed description. It should be construed that all modifications or modified aspects derived from the meaning and scope of the appended claims and equivalent concepts thereof fall within the scope of one or more embodiments.

What is claimed is:

1. An organic light emitting diode display device comprising: a display panel including two or more pixels, each of which includes an organic light emitting diode (OLED) and a transistor that supplies a current to the organic light emitting diode (OLED); a data driver for converting a digital signal into one of a positive polarity analog signal and a negative polarity analog signal and for outputting the converted signal to the transistor of each pixel; and a timing controller for controlling the data driver, wherein the data driver converts the digital signal into the negative polarity analog signal having a voltage lower than a lower voltage of either a source voltage or a drain voltage of the transistor of each pixel when the digital signal represents black, and wherein the data driver outputs the negative polarity analog signal to a gate of the transistor included in each pixel representing black image in a frame.

2. The organic light emitting diode display device of claim 1, wherein the data driver comprises:

a digital to analog conversion unit for converting the digital signal into one of the positive polarity analog signal and the negative polarity analog signal; and an output circuit unit for outputting, to the transistor of each of the pixels, either the positive polarity analog signal or the negative polarity analog signal as an output signal.

3. The organic light emitting diode display device of claim 2, wherein the digital to analog conversion unit comprises an M-bit first DAC (M is a natural number greater than 1) which converts the digital signal into the positive polarity analog signal and an N-bit second DAC (N is a natural number greater than 1) which converts the digital signal into the negative polarity analog signal.

4. The organic light emitting diode display device of claim 3, wherein the M is greater than the N.

5. The organic light emitting diode display device of claim 1, wherein the data driver converts the digital signal representing black in a frame into the negative polarity analog signal in proportion to a magnitude of another digital signal of a previous frame.

6. The organic light emitting diode display device of claim 5, wherein a resolution of the positive polarity analog signal is higher than a resolution of the negative polarity analog signal.

7. The organic light emitting diode display device of claim 6, wherein an absolute value of a maximum value of a magnitude of the positive polarity analog signal is same as an absolute value of a minimum value of a magnitude of the negative polarity analog signal.

8. A data driver comprising:

a digital to analog conversion unit for converting a digital signal into either a positive polarity analog signal or a negative polarity analog signal; and an output circuit unit for outputting, to a transistor that supplies a current to an organic light emitting diode (OLED), either the positive polarity analog signal or the negative polarity analog signal as an output signal, wherein the digital to analog conversion unit converts the digital signal into the negative polarity analog signal having a voltage lower than a lower voltage of either a source voltage or a drain voltage of the transistor when the digital signal represents black, and wherein the output circuit unit outputs the negative polarity analog signal as the output signal to a gate of the transistor included in each pixel representing black image in a frame.

9. The data driver of claim 8, wherein the digital to analog conversion unit comprises an M-bit first DAC (M is a natural number greater than 1) which converts the digital signal into the positive polarity analog signal and an N-bit second DAC (N is a natural number greater than 1) which converts the digital signal into the negative polarity analog signal.

10. The data driver of claim 9, wherein the M is greater than the N.

11. The data driver of claim 8, wherein the digital to analog conversion unit converts the digital signal representing black in a frame into the negative polarity analog signal in proportion to a magnitude of another digital signal of a previous frame.

12. The data driver of claim 11, wherein a resolution of the positive polarity analog signal is higher than a resolution of the negative polarity analog signal.

13. The data driver of claim 12, wherein an absolute value of a maximum value of a magnitude of the positive polarity analog signal is same as an absolute value of a minimum value of a magnitude of the negative polarity analog signal.

* * * * *